US008641494B2

(12) United States Patent
Matthews

(10) Patent No.: US 8,641,494 B2
(45) Date of Patent: Feb. 4, 2014

(54) VENTILATION DEVICE AND FRAME SYSTEM

(75) Inventor: Christopher James Matthews, Rozelle (AU)

(73) Assignee: Silenceair International Pty Limited, Sydney (AU)

( * ) Notice: Subject to any disclaimer, the term of this patent is extended or adjusted under 35 U.S.C. 154(b) by 1482 days.

(21) Appl. No.: 11/579,628

(22) PCT Filed: May 9, 2005

(86) PCT No.: PCT/AU2005/000661

§ 371 (c)(1),
(2), (4) Date: Aug. 12, 2008

(87) PCT Pub. No.: WO2005/108696

PCT Pub. Date: Nov. 17, 2005

(65) Prior Publication Data

US 2009/0011696 A1 Jan. 8, 2009

(30) Foreign Application Priority Data

May 7, 2004 (AU) ..... 2004902507
May 7, 2004 (AU) ..... 2004902508
May 7, 2004 (AU) ..... 2004902509

(51) Int. Cl.
*F24F 13/24* (2006.01)
*G10K 11/00* (2006.01)
*G10K 11/172* (2006.01)

(52) U.S. Cl.
CPC ..... *F24F 13/24* (2013.01); *Y10S 454/906* (2013.01)
USPC ..... 454/262; 454/906; 454/346; 181/224

(58) Field of Classification Search
USPC ..... 454/254, 262, 346, 906; 181/224, 212
See application file for complete search history.

(56) References Cited

U.S. PATENT DOCUMENTS 1,816,769 A * 7/1931 Fisk ..... 454/254
1,929,595 A 10/1933 Macleod (Continued)

FOREIGN PATENT DOCUMENTS

JP 58-30581 2/1983
JP 2000097009 4/2000

(Continued)

*Primary Examiner* — Steven B McAllister
*Assistant Examiner* — Frances H Kamps
(74) *Attorney, Agent, or Firm* — Michael Best & Friedrich LLP

(57) ABSTRACT

A ventilation device comprises a body (11) having first and second ports (14, 15) and a ventilation passage (13) that extends through the body between the ports to allow airflow through the body. The ventilation device also comprises a noise attenuation device (21) arranged to attenuate noise transmission through the passage in at least one direction from the first to the second port. The noise attenuation device comprises at least one array (22, 23) of noise attenuation tubes disposed in the ventilation body. In one form, the noise attenuation device (21) include two arrays of attenuator tubes disposed on respective opposite sides of the passage (13). The tubes each have a mouth (27) that opens to the passage and a central axis that extends from the mouth in the direction of elongation of that tube. At least some of the tubes in the first array (20) oppose at least some of the tubes in the second array (23) with the central axes of the opposing tubes at the region of their mouths (27) being mutually inclined.

11 Claims, 9 Drawing Sheets

(56) References Cited

U.S. PATENT DOCUMENTS

| | | | | | |
|---|---|---|---|---|---|
| 2,950,776 | A | * | 8/1960 | Stephens | 181/224 |
| 3,378,100 | A | * | 4/1968 | Welty | 181/224 |
| 3,630,310 | A | * | 12/1971 | Federer | 181/210 |
| 3,726,359 | A | * | 4/1973 | Dierl et al. | 181/224 |
| 3,913,702 | A | | 10/1975 | Wirt et al. | |
| 4,091,892 | A | * | 5/1978 | Hehmann et al. | 181/286 |
| 4,109,754 | A | | 8/1978 | Purhonen | |
| 4,236,597 | A | * | 12/1980 | Kiss et al. | 181/224 |
| 4,241,806 | A | * | 12/1980 | Metzger | 181/284 |
| 4,243,117 | A | * | 1/1981 | Warnaka | 181/286 |
| 4,287,962 | A | * | 9/1981 | Ingard et al. | 181/224 |
| 4,298,090 | A | * | 11/1981 | Chapman | 181/286 |
| 4,330,047 | A | * | 5/1982 | Ruspa et al. | 181/224 |
| 4,336,863 | A | * | 6/1982 | Satomi | 181/224 |
| 4,339,018 | A | * | 7/1982 | Warnaka | 181/286 |
| 4,378,859 | A | * | 4/1983 | Satomi et al. | 181/224 |
| 4,645,032 | A | * | 2/1987 | Ross et al. | 181/250 |
| 5,274,201 | A | * | 12/1993 | Steele | 181/224 |
| 5,310,586 | A | * | 5/1994 | Mullen | 428/34.1 |
| 5,480,464 | A | * | 1/1996 | De Villiers et al. | 55/320 |
| 5,532,439 | A | * | 7/1996 | Minkin | 181/224 |
| 5,588,271 | A | | 12/1996 | Pitchford | |
| 5,601,485 | A | | 2/1997 | Gigola | |
| 5,663,536 | A | * | 9/1997 | Kaplan | 181/224 |
| 5,687,521 | A | | 11/1997 | Carlson et al. | |
| 5,696,361 | A | * | 12/1997 | Chen | 181/224 |
| 5,983,888 | A | * | 11/1999 | Anselmino et al. | 126/299 R |
| 6,089,347 | A | * | 7/2000 | Flugger | 181/264 |
| 6,116,375 | A | * | 9/2000 | Lorch et al. | 181/224 |
| 6,145,616 | A | * | 11/2000 | Ewanek | 181/224 |
| 6,253,873 | B1 | * | 7/2001 | Norres et al. | 181/224 |
| 6,450,289 | B1 | * | 9/2002 | Field et al. | 181/224 |
| 6,651,773 | B1 | * | 11/2003 | Marocco | 181/270 |
| 6,688,424 | B1 | * | 2/2004 | Nakada et al. | 181/224 |
| 6,789,646 | B2 | * | 9/2004 | Wang et al. | 181/293 |
| 6,892,851 | B2 | * | 5/2005 | Lee | 181/224 |
| 7,025,799 | B2 | * | 4/2006 | Peterson | 55/385.3 |
| 7,111,831 | B2 | * | 9/2006 | Hentschel et al. | 261/110 |
| 7,712,576 | B2 | * | 5/2010 | Goto et al. | 181/225 |
| 7,789,194 | B2 | * | 9/2010 | Lathrop et al. | 181/225 |
| 2003/0173146 | A1 | * | 9/2003 | Wolf et al. | 181/224 |
| 2005/0161280 | A1 | * | 7/2005 | Furuya | 181/225 |
| 2007/0169528 | A1 | * | 7/2007 | Schultz et al. | 72/48 |
| 2008/0190711 | A1 | * | 8/2008 | Patrick et al. | 187/401 |
| 2008/0233856 | A1 | * | 9/2008 | Okawa et al. | 454/143 |
| 2009/0020358 | A1 | * | 1/2009 | Derks et al. | 181/224 |
| 2010/0126810 | A1 | * | 5/2010 | Opoku et al. | 187/401 |

FOREIGN PATENT DOCUMENTS

| | | |
|---|---|---|
| JP | 2001311112 | 11/2001 |
| JP | 2002089228 | 3/2002 |
| JP | 2002519542 | 7/2002 |
| WO | WO 99/10608 | 3/1999 |
| WO | WO 99/67476 | 12/1999 |
| WO | 0029684 | 5/2000 |
| WO | WO 00/24983 | 5/2000 |
| WO | WO 02/50812 | 6/2002 |
| WO | WO 02/103130 | 12/2002 |

* cited by examiner

VENTILATION DEVICE AND FRAME SYSTEM

FIELD OF THE INVENTION

The present invention broadly relates to a ventilation device that is used to ventilate a building or other enclosed structure and that is able to attenuate noise transmission through the device. In a further aspect, the invention relates to a frame system, and associated components, that facilitate installation of one or more ventilation devices in a structure.

The invention is described below in the context of being used in a building. However, it is to be appreciated that it is not limited to that use. For example, the invention may be used in other industrial applications such as in machine housings, air conditioning systems and the like.

BACKGROUND OF THE INVENTION

Walls of buildings are often ventilated by vents that allow exchange of external and internal air. A disadvantage of such conventional vents is that the external noise is transmitted through the exterior to the interior via the vents. To address this problem, a ventilation device has been proposed that attenuates the noise transmission by the use of an array of quarter wave resonators which are disposed adjacent an aperture or ventilation opening. Such a device is the subject of international application WO 00/29684. The ventilation device disclosed in this application incorporate an array of quarter wave attenuator tubes that are tuned to a resonant frequency. The device functions by dispersing or scattering soundwaves rather than by absorbing them. To extend the acoustic wavelength spectrum that is attenuated, the array comprises tubes of different widths and length.

SUMMARY OF THE INVENTION

A first aspect of the present invention is directed to improvements in a ventilation device that incorporates a noise attenuation device that uses attenuator tubes of the type generally as disclosed in the above mentioned application.

Accordingly, a ventilation device is disclosed comprising a body having first and second ports, a ventilation passage extending through the body between the ports to allow airflow through the body, a noise attenuation device arranged to attenuate noise transmission through the passage in at least one direction from the first to the second port, the noise attenuation device comprising first and second arrays of attenuator tubes disposed on respective opposite sides of the passage, the tubes each having a mouth that opens to the passage and a central axis extending from the mouth in the direction of the elongation of that tube, wherein at least some of the tubes in the first array opposes at least some of the tubes in the second array with the central axes of the opposing tubes at the region of their mouths being mutually inclined.

The attenuator tubes act as quarter wave resonators which by virtue of their size and shape are able to scatter the soundwaves in the passage so as to attenuate the noise in the ventilation passage. In the past, when arrays of attenuator tubes have been used on opposing sides of a ventilation passage (for example as disclosed in international application WO 00/29684), the opposing tubes have been arranged so that their central axes are parallel or coaxial.

Surprisingly, the inventor has observed that the efficiency in noise reduction is not significantly affected if the opposing tubes are mutually inclined (i.e. disposed relative to one another such that the central axes at the tube mouths are not coaxial or parallel but at an angle of greater or smaller than 180°). In contrast, the inventor has found that it may be possible to further enhance the performance of the device in attenuating noise travelling through the passage by such an arrangement. Furthermore, by angling the opposing tubes, it is possible to better utilize the volume space of the ventilation device body.

In a particular form, at least some of the tubes in both the first and second arrays open to the passage so that the central axes at their mouths are angled towards the first port. The inventor has found that such an arrangement enhances the operation of the device. Specifically, as soundwaves move along the passage they need to pass into the attenuator tubes for noise to be attenuated. By facing the tubes towards the first port (i.e. towards the noise source), the tubes are better presented to the oncoming soundwaves to receive those soundwaves. Moreover soundwaves that are not cancelled within the tube are reflected back into the passage in the direction of the noise source which it is considered further enhances the effectiveness of the attenuation device to reduce noise transmission through the ventilation passage.

In one form the tubes of each array may be formed in different shapes and sizes to broaden the spectrum of acoustic wavelengths across which the device is effective. Further the tubes may be generally linear, they may be curved or kinked, and/or may be cylindrical or tapered or may be in any combination of the above.

In one form, each array of tubes includes tubes of different length. In one form, the tubes are arranged so that they are in either ascending or descending length along a section of the array.

In one form, the tubes are substantially linear so that in a particular form, the central axes of the respective tubes of an array are generally parallel. In an alternative arrangement, where the tubes are generally linear, at least some of the axes of the tubes are inclined to the axes of other tubes within the same array.

In one particular embodiment, the opposing tubes of the first and second arrays are disposed substantially at right angles to one another.

In a particular embodiment, the body includes a housing in which the first and second arrays are disposed. In a particular embodiment, the housing is shaped generally as a rectangular prism having opposite front and back surfaces, opposite top and bottom surfaces and opposite side surfaces. In a particular form, the ports are disposed in the front and back surfaces. In a particular embodiment, the tubes of one array are disposed with their axes substantially perpendicular to the front and back surfaces, whereas the axes of the tubes of the second array are disposed substantially perpendicular to the top and bottom surfaces.

In one form, the ventilation passage is straight. In another embodiment, the ventilation passage is kinked.

In a particular embodiment, the device is arranged so that the attenuator tubes are disposed on opposite sides of the ventilation passage along at least a major part of its length. In a particular embodiment at least a major portion of the opposing attenuator tubes have their central axes at the region of their mouths mutually inclined.

In another aspect, a ventilation device is disclosed that comprises a body having first and second ports, a ventilation passage extending through the body between the ports to allow airflow through the body, a noise attenuation device arranged to attenuate noise transmission through the passage in at least one direction from the first to the second port, wherein the noise attenuation device comprises at least one array of attenuator tubes disposed on one of the sides of the passage, the tubes each having a mouth that opens to the ventilation passage, and a tube cavity that extends from the mouth in the direction of elongation of the tube, wherein at least some of the attenuator tubes incorporate an acoustic transmissive partition which separates at least a portion of those attenuator tube cavities from the ventilation passage.

Surprisingly, the inventor has found that the use of an acoustic transmissive partition in at least some of the attenuator tubes does not inhibit the noise reduction provided by the device, but may in fact enhance these properties.

The partitions may take any form such as walls or coverings that are arranged so that sound may be transmitted but in one form, these partitions are in the form of films. The films may be formed from a polymeric material such a polyethylene and in a particular embodiment, the film has a thickness of less than 100 μm and in further form, less than 50 μm. The partitions may be formed from a continuous material or may be formed of a mesh or similar grid-like structure.

In one particular embodiment, the partitions are in the form of a film which is applied over the mouths of the attenuated tubes which open into the passage. In this way, the partition forms a lining of the passage. This arrangement has particular benefit in that it can seal off the attenuator cavity thereby reducing the likelihood of contamination and facilitating cleaning of the ventilation device.

In an alternative arrangement, each partition may be positioned within the cavity of a respective attenuator tube. For example, the partitions may be inserted into the tubes or alternatively, the arrays may be formed in multiple parts and the partitions may be applied between those parts as a continuous sheet.

The partitions may be integrally formed with the attenuator tubes, but in a particular embodiment are adhered or welded to respective attenuator tubes. The partitions may be adhered or welded to every attenuator tube or may be adhered or welded to distinct portions of the tube array and span across the mouths of attenuator tubes positioned between those distinct portions.

In a further aspect, the invention relates to a noise attenuation array that incorporates an acoustic transmissive partition.

In another aspect, the invention is directed to a system to facilitate installation of units, such as the ventilation devices described above, into a structure. In a particular form, the invention is directed to a system, and components used in that system, which facilitate the installation of a plurality of units as a bank into in a conventional frame, such as a glazing frame. In particular, the number of units which form the bank may be varied so as to provide a modular structure that can be scaled up or down in size to suit particular need.

According to this aspect, there is disclosed a modular structure comprising one or more modules, and coupling elements that project from the modules and which are arranged to locate within a complementary frame disposed in a supporting structure so as to connect the modular structure to the supporting structure.

The modules may take any form, for example they may be glass blocks or air-conditioning units but preferably are ventilation devices. Each ventilation device may comprise a housing and an array of attenuator tubes arranged to attenuate noise transmission through the ventilation device. As such, the ventilation device may be in any form described above, but it is to be appreciated that it is not limited to those forms.

In one form, the modular structure is arranged to be installed in a window opening with the complementary frame being a conventional glazing frame that is arranged to receive a pane of glass. Such glazing frames are typically, but not exclusively formed from a metal extrusion, and include a channel operative to capture edges of the glass pane. In a particular form, the coupling elements are designed to locate in this channel to thereby allow the modular structure to be installed in the same, or similar way as a pane of glass.

In one form, the modules include coupling elements on their outer surface to allow the modules to be connected together. These module coupling elements may interconnect by any suitable technique such as through a snap fit, or by sliding or rotational movement, or by the use of mechanical fasteners, or by some combination of the above.

In one form, the module coupling elements are also designed to inter-engage with the coupling elements used to mount the structure to a supporting structure.

In one form, the mounting coupling elements are installed individually onto selected ones of the modules, such as through the module coupling elements. In another form, the modular structure further comprises a frame and the mounting coupling elements are disposed on that frame.

In one form, the frame is arranged to inter-engage with the module coupling elements to provide a least part of the connection of the frame to the bank of interconnected modules.

In one form, the frame is formed from a frame element that has a constant cross-section. In this way, the frame can be made merely by cutting frame elements to size and interconnecting those frame elements about the bank of modules.

In a particular embodiment, the frame element has a body portion which locates against the modules and a blade portion that projects from the frame element body. This blade element forms a coupling element of the modular structure and locates in the complementary frame of the supporting structure.

In a particular embodiment, the frame also incorporates lifting lugs which are designed to receive a suitable lifting device to simplify the lifting of the modular structure so as to facilitate installation of the structure in the complementary frame. In one form these lifting lugs are disposed on the blade element.

In a particular form, these lifting lugs may be concealed by a cover strip that extends over at least part of the frame to improve the appearance of the structure.

In a particular embodiment, the modular structure also comprises reinforcing elements to strengthen the structure, particularly against wind loading. In one form, upright reinforcing is installed between adjacent modules in the bank. In a particular form, where the structure incorporates a frame, these upright reinforcing members extend between top and bottom frame elements. Similarly the modular structure may include cross reinforcing elements that extend between side frame elements.

In the form where the modular structure incorporates a frame, that frame may provide some structural strength to the modular structure. In one form, the frame element includes a cavity operative to receive a reinforcing element to further increase the strength of the structure. In one form, this cavity faces inwards so that in use, it opens onto the modules.

In yet a further aspect, the invention is directed to a frame element for use in the modular structure.

In yet a further aspect, there is provided a modular structure comprising:

a plurality of modules that in use form an array of modules, each module comprising a first part and a second part, the first and the second parts having coupling means and respective first and second parts being inter connectable to each other and to respective first and second parts of the or each adjacent module by the coupling means, a frame operative to be secured to a support structure and comprising at least one member locatable between the or each adjacent module wherein on interconnecting respective first and second parts of each module together and on inter-connecting respective first and second parts of adjacent modules together the or each member is captured between adjacent modules.

As the or each member is captured between adjacent modules, an array of securely inter-connected modules may be formed.

The modular structure according to this form preferably is arranged to be assembled sequentially in the same sequence as the parts of the modules are assembled. For example, the frame and the modules may be assembled row-by-row or column by column.

Yet a further invention provides a method of forming an array of inter-connectable modules mountable to a building structure, each module comprising a first part and a second part, respective first and second parts being inter-connectable to each other and to respective first and second parts of the or each adjacent module, the array of modules further comprising a frame being operative to be secured to the building structure, the method comprising the steps of:

positioning a plurality of first parts of the modules to form an array of the first parts interconnecting adjacent first parts, positioning at least one member between the first parts, positioning a plurality of second parts of the modules over respective first parts and interconnecting respective first and second parts of the modules, wherein on interconnecting respective first and second parts of each module together and on inter-connecting respective first and second parts of adjacent modules together the or each member is captured between adjacent modules.

The inventions will be more fully understood from the following description of preferred embodiments of the inventions. The description is provided with reference to the accompanying drawings.

DETAILED DESCRIPTION OF A PREFERRED EMBODIMENT

Figure 1:
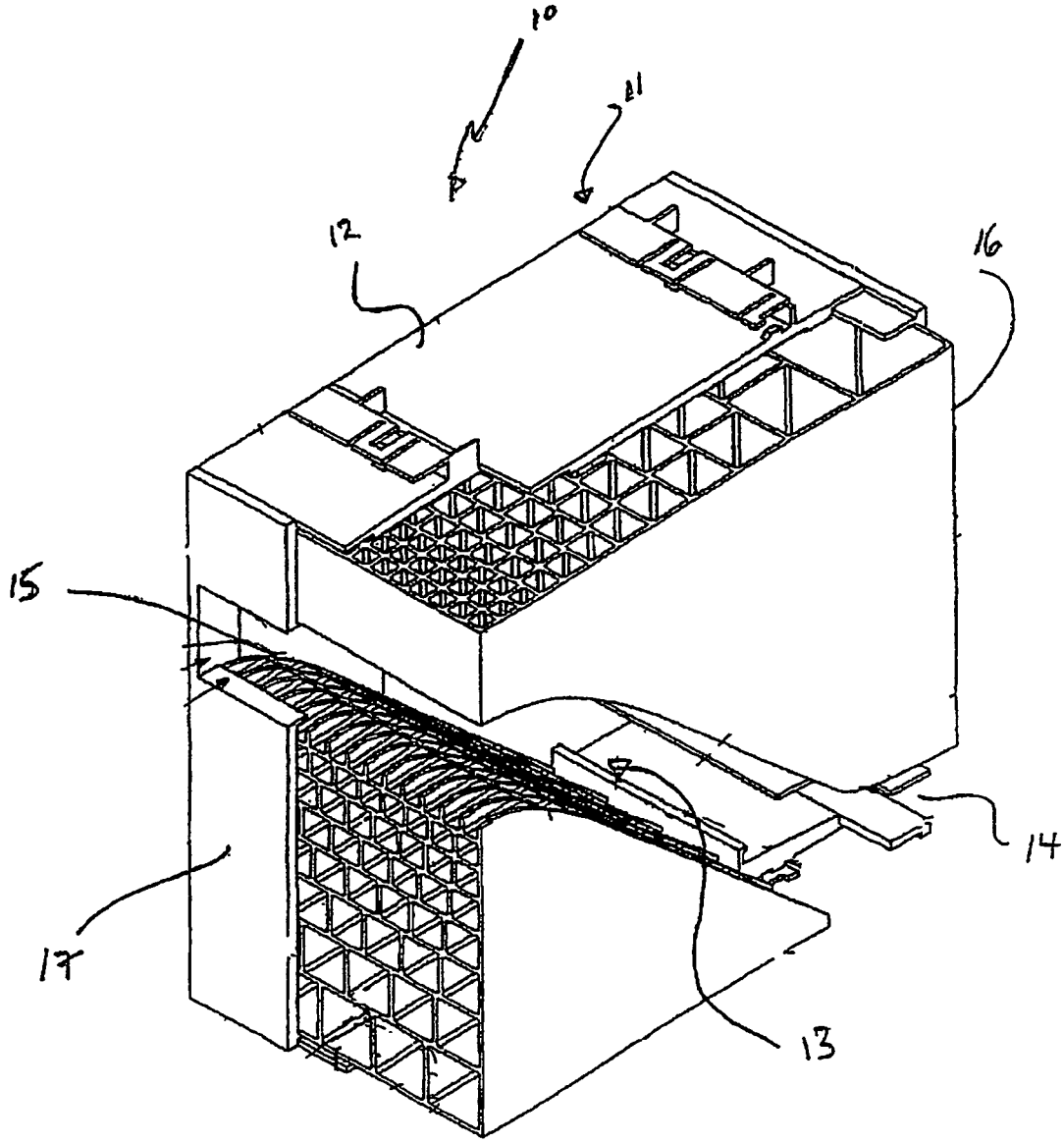
FIG. 1 is a partially cut away perspective view of a , ventilation device according to a preferred embodiment of the invention.
Figure 2:
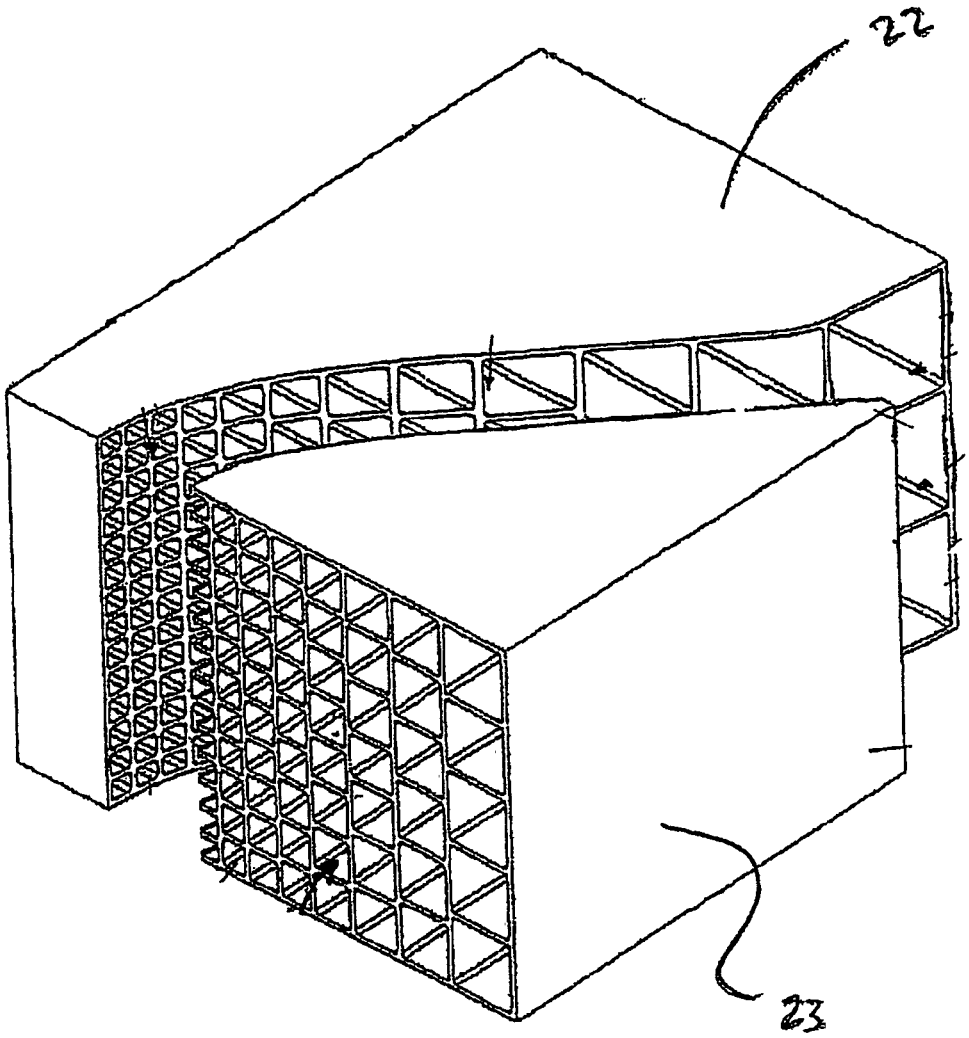
FIG. 2 is a perspective view of an attenuation device of the ventilation device of FIG. 1.
Figure 3:
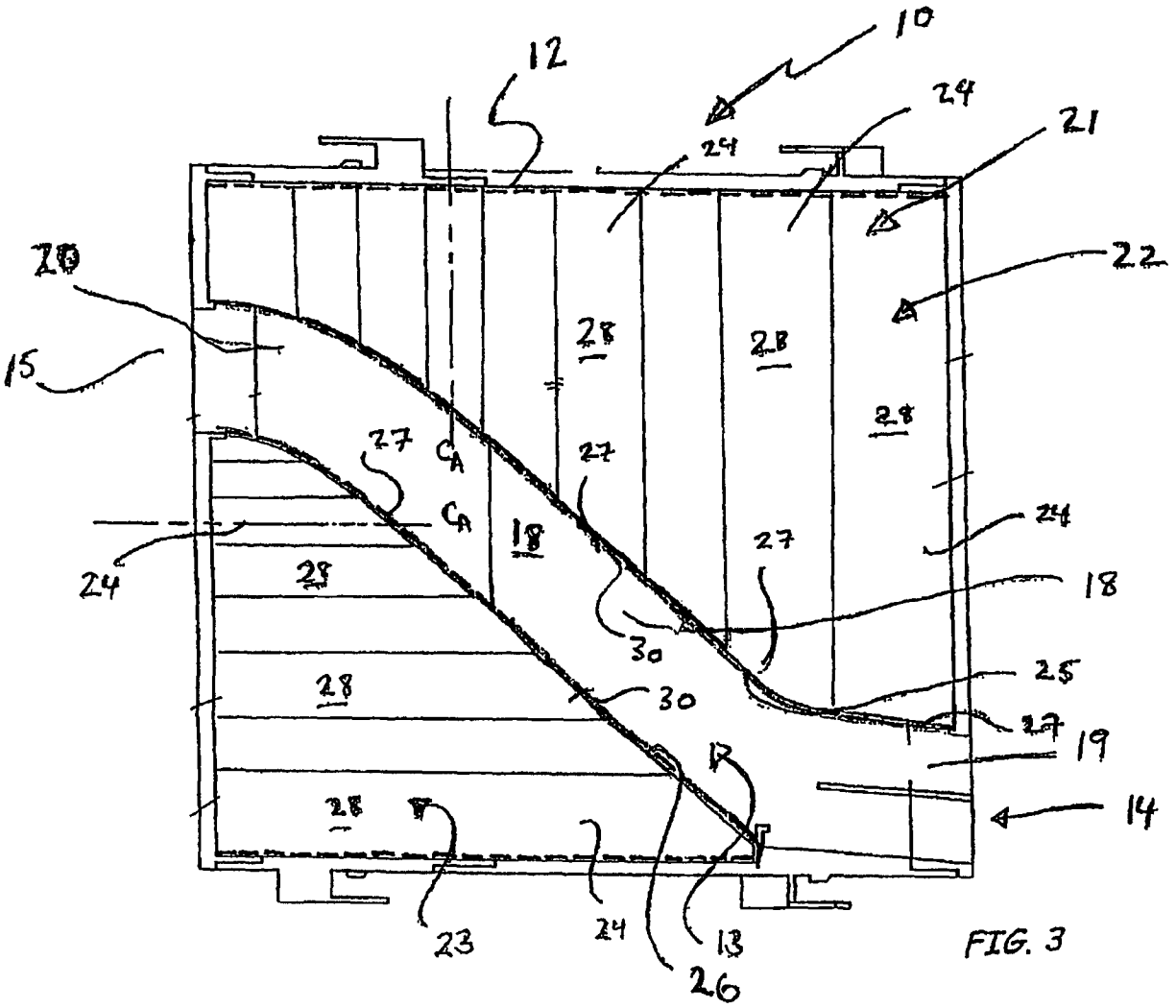
FIG. 3 shows a cross-sectional representation of the ventilation device of FIG. 1.

Referring to FIGS. 1 to 3, a ventilation device 10 comprises a body 11 which in the illustrated form is a housing 12 (partially cut away in FIG. 1) that is shaped generally as a rectangular prism. The body incorporates a ventilation passage 13 that extends between first and second ports (14, 15) disposed on opposite front and back faces (16, 17) of the housing. The ventilation passage is kinked so that there is no line of sight through the device 10. In the embodiment shown, the passage has a central straight portion 18 and opposite arcuate end portions (19, 20) that terminate at the respective first and second ports (14, 15).

The ventilation device further comprises an attenuation device 21 that is operative to attenuate noise transmitted through the passage from the first to the second port. The noise attenuation device comprises two opposing arrays 22 and 23 of quarter wavelength attenuator tubes 24. The arrays are disposed in the housing 12 on opposite sides 25, 26 of the ventilation passage 13. Each attenuator tube 24 has a mouth 27 that opens onto the ventilation passage, and a cavity 28 that extends along the central axis CA of that tube in the direction of elongation of the tube.

The tubes 24 are configured as quarter wave resonators that are operative to attenuate noise at a frequency to which that tube is tuned. To extend the acoustic wavelength spectrum that is attenuated, each array (22, 23) has a range of different mouth dimensions and different lengths. Each array comprises rows and columns of the tubes. In this example the tubes are arranged so that their dimensions decrease in a direction along the ventilation passage from the first port 14 to the second port 15. Further, each attenuator tube 24 has an internal width that decreases slightly in a direction away from the mouth and towards the closed end. It is preferred to have the tube walls parallel, but a slight taper is required when the arrays are formed from an injection moulding process to allow the moulding tool to be drawn from the formed tube.

Further in the illustrated form, the tubes are straight and the tubes in each array are in a parallel configuration. It is to be appreciated that the tubes in a particular array may be mutually inclined.

As indicated above, the attenuator arrays 22, 23 are disposed on opposite sides of the ventilation passage 13 so that the respective mouths 27 of the attenuator tubes 24 open onto the ventilation passage 13. Furthermore, as best illustrated in FIG. 3, the arrays are arranged so that the central axes CA of the tubes of one array 22 are mutually inclined to the central axes CA of the tubes of the other array 23. In the illustrated form, the arrays 22 and 23 are arranged so that this angle is substantially at 90°.

As may be seen specifically from FIG. 3, this arrangement has the significant advantage that it enables the attenuation device to be very compact for a given maximum length of tube. In particular, the outer-periphery of the arrays 22 and 23 effectively take up the entire shape of the rectangular prismic housing 12 as such the entire interior volume of the housing 12 is utilised by the arrays 22 and 23 and the ventilation passage 18 that extends through the housing.

In addition, and again as best illustrated in FIG. 3, the arrangement of the respective arrays and the configuration of the ventilation passage with its straight portion 18 and arcuate portions 19 and 20 is such that at least the majority of the tubes 24 are orientated so that they face towards the noise source which in the illustrated embodiment is the port 14. This arrangement is considered to improve the operation of the device. Specifically, as soundwaves move along the passage they need to pass into the attenuator tubes for noise to be attenuated. By facing the tubes towards the first port, the tubes are better presented to the oncoming soundwaves to receive those soundwaves. Moreover, soundwaves that are not cancelled within the tube are reflected back into the passage in the direction of the noise source which is considered further enhances the effectiveness of the attenuation device to reduce noise transmission through the ventilation passage.

In addition, as best illustrated in FIG. 3, a film 30 is applied over the arrays 22 and 23 so as to cover the mouths 27 of the respective tubes 24 and form a lining on the opposite sides 25, 26 of the ventilation passage 13. The film forms an acoustic transmissive partition which separates the individual cavities 28 of the tubes to the ventilation passage 13 thereby concealing the interior of each of the attenuated tubes 24, but still allows the tubes to function to attenuate noise.

By incorporating the film 30 over the arrays, there is a reduced likelihood of contamination within the interior of the attenuated tubes and also cleaning of the ventilation passage is significantly improved. Also the inventor has found that the film can improve the effectiveness of the noise attenuation device 21.

In the embodiment, the film 30 is composed of a polymeric material such as polyethylene and has a thickness of less than 100 μm and more preferably less than 50 μm. Each film is adhered to a respective mouth 27 so as to fully seal each cavity.

Figure 4:
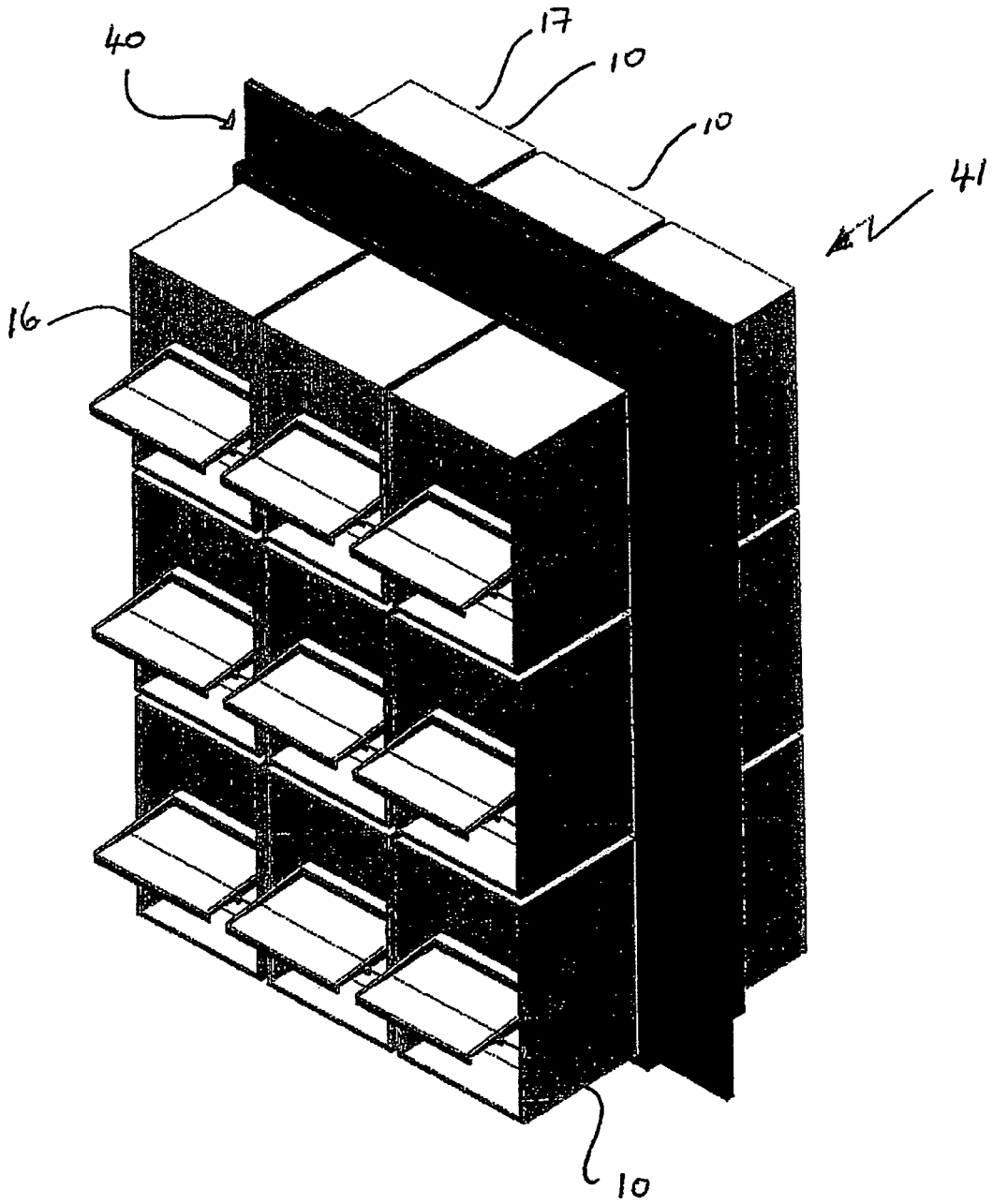
FIG. 4 illustrates a bank of the ventilation devices of FIG. 1.

FIG. 4 illustrates a bank 41 of the ventilation devices which are connected together and are incorporated in a frame 40 which extends about the periphery of the interconnected bank of the ventilation devices 10. The frame extends around a mid region of the devices 10 intermediate the front and back faces 16 and 17 of the individual ventilation devices.

Figure 7:
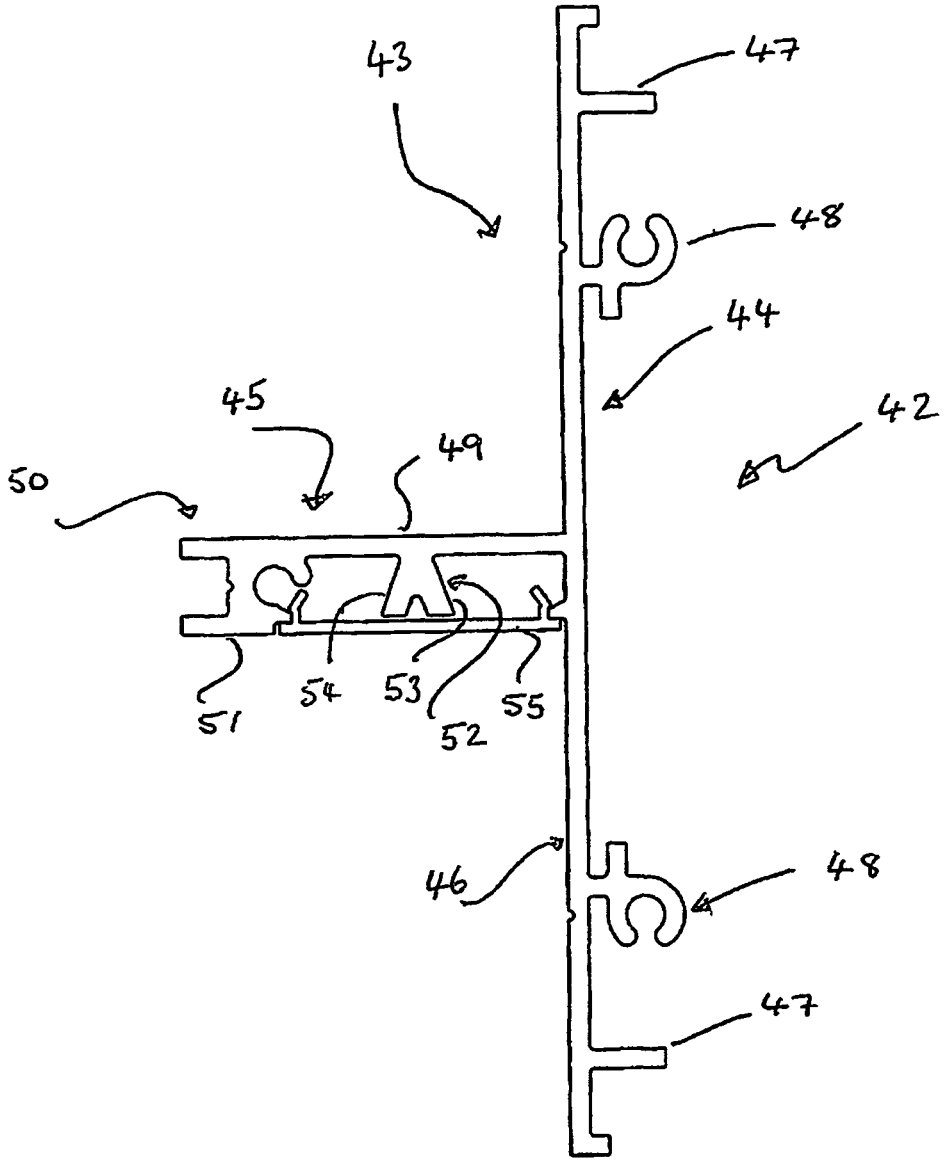
FIG. 7 is a detailed view of the frame used in the bank of ventilation devices of FIG. 4.

The frame 40 is made up from interconnected frame elements 42 which are typically formed as an extruded section having a constant cross section as best illustrated in FIG. 7. The frame elements are cut to size and are assembled together into the frame 40 using bevel joints at the corners secured together by mechanical fasteners.

Turning to the frame element 42 as illustrated in FIG. 7, the element includes a body portion 43 having an inner surface 44 which locates against the housing 11 of the ventilation devices 10 and a coupling portion or blade 45 which projects outwardly from an outer surface 46 of the body portion 43.

The body portion 43 of the frame element 42 includes inwardly directed legs 47 which project from the inner side 44 of the body portion, and fixing screw slots 48 which are also disposed on the inner surface 44. The screw slots 48 are adapted to receive mechanical fasteners to enable the cut elements to be interconnected.

The blade portion 45 is dimensioned to be equivalent to a standard thickness of a glass panel and as will be discussed in more detail below, is designed to locate within a standard glazing frame profile 60 (see FIGS. 5 and 6). In this regard, the blade includes a planar surface 49 which extends the entire length of the blade 45. The blade 45 terminates in a head region 50 which incorporates an opposite planar surface 51 with the distance between the surfaces 49 and 51 at the head region 50 being dimensioned so as to locate within the channel 61 of the glazing frame 60 (see FIGS. 5 and 6).

The blade 45 also includes a lifting lug 52 disposed midway along its length and facing away from the surface 49. The lifting lug 52 is dimensioned so that its outer end is within the envelope defined by the surface 51. The lifting lug 52 includes opposite tapered surfaces 53 and 54 and is designed to provide an anchor point for a lifting device (not shown) to allow lifting of the bank 41 of ventilation devices so as to facilitate installation of those devices into the glazing frame. A cover strip 55 is able to snap over the lifting lug. The cover 55 is aligned with the surface 51 at the head region 50 of the blade so as to provide a planar surface on that side of the blade 45.

Figure 5:
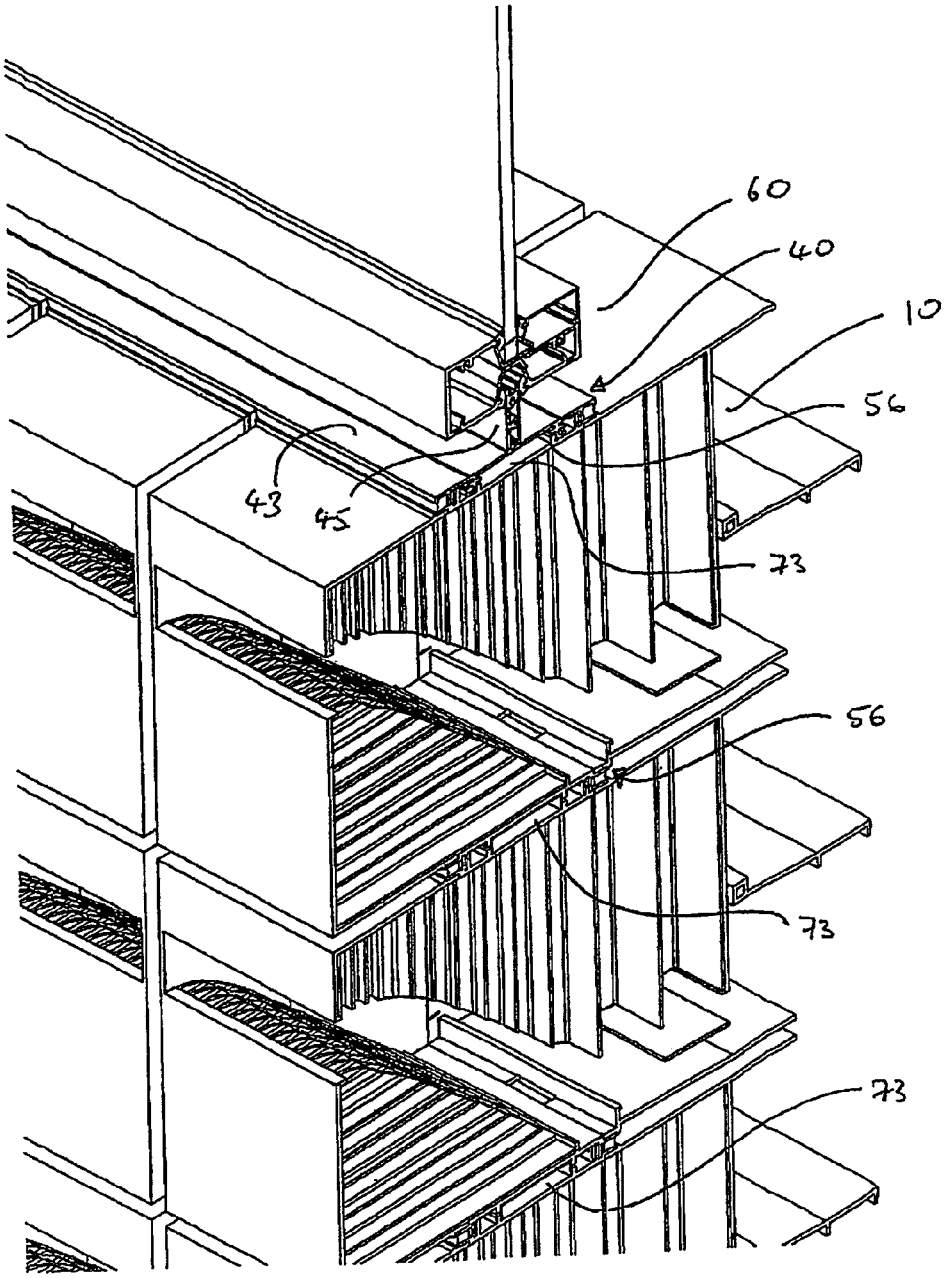
FIG. 5 is a detailed view of an upper connection of the bank of ventilation devices of FIG. 4 in a glazing frame.
Figure 6:
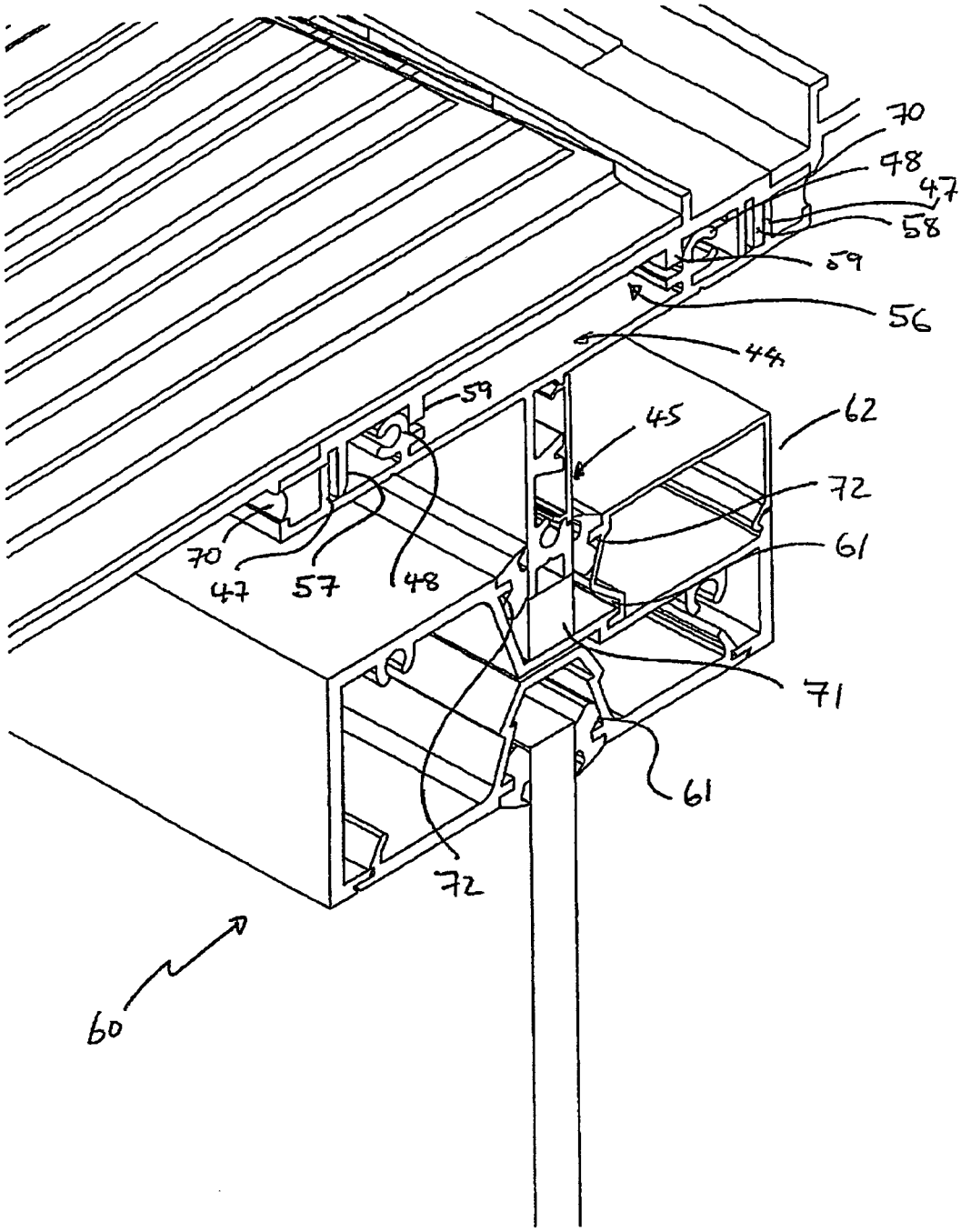
FIG. 6 is a detailed view of a lower connection of the bank of ventilation devices of FIG. 4 in a glazing frame.

As best illustrated in FIGS. 5 and 6, the individual ventilation devices are arranged to be coupled together by coupling elements 56 which are disposed on the housing 11 of the individual units. These coupling elements 56 include a tang 57 and slot 58 arrangement wherein the tang of one coupling element 56 locates in a snap fit arrangement in the slot of an adjacent ventilation device so as to interconnect the ventilation devices in a snap fit arrangement. Typically the coupling elements 56 are disposed both on the upper and lower surface of the housing 11 of the ventilation device as well as on the opposite side surfaces.

In addition to enabling interconnection of the individual ventilation devices, the coupling elements 56 also locate the frame element 42 in position on those surfaces of the bank 41 of the ventilation devices that are exposed. As best illustrated in FIGS. 5 and 6, the inner surface 44 of the frame 40 is designed to locate over the coupling element 56. In the embodiment shown, the frame element 41 does not engage with either the tang 57 or slots 58 of the coupling element 56. Rather the coupling element includes two short legs 59 which project downwardly and which are arranged to engage with an inner surface of the fixing slots 48 so as to provide an interference fit between the frame element 42 and the coupling element 56 to resist relative lateral movement of those components. The legs 47 on the body portion 43 of the frame element 42 is design to butt against the housing 11 so as to provide an abutment surface which enables a silicone seal 70 to be applied between the housing 11 and the frame 40 on end region of the frame 40.

In addition, the frame element 41 and the coupling elements 56 are shaped so that when the frame element is connected to a coupling element or two coupling elements are connected together, a channel 73 is formed which can accommodate reinforcing elements (not shown) to strengthen the modular structure. These channels extend both horizontally and vertically and can therefore accommodate both horizontal and vertical reinforcing.

The glazing frame 60 includes channel 61 which is operative to receive the blade 45. In the illustrated form, the glazing frame 60 includes dual channels so as to form a transom. A removable glazing bead 62 is provided to facilitate location of the blade 45 into the glazing channel 61.

In use, the bank 41 of ventilation devices is typically manufactured offsite and is delivered as a single unit onsite. The bank 41 is lifted into place using a lifting device which attaches to the lifting lugs 52 on the frame, most typically on the vertical edges of the frame 40. Initially the bead 62 of the glazing frame 60 is removed on at least one of the sides (normally lower side) of the glazing frame. The bank is then maneuvered into place by locating the top edge into the respective glazing frame channel (see FIG. 5). The side edges are then installed in the side frames. A block 71 is located within the glazing frame 61 on the lower side (as shown in FIG. 6) and the bank is then dropped in position to rest on the block 71.

Once the bank 41 of ventilation panels is installed with the blades in the respective channels of the glazing frame 60, the glazing bead 62 is fitted back in place as is the cover strip 55 of the frame element 42. Glazing seals 72 are then fitting between the glazing frame 60 and the blade 45 to provide a watertight seal along that joint.

Figure 8B:
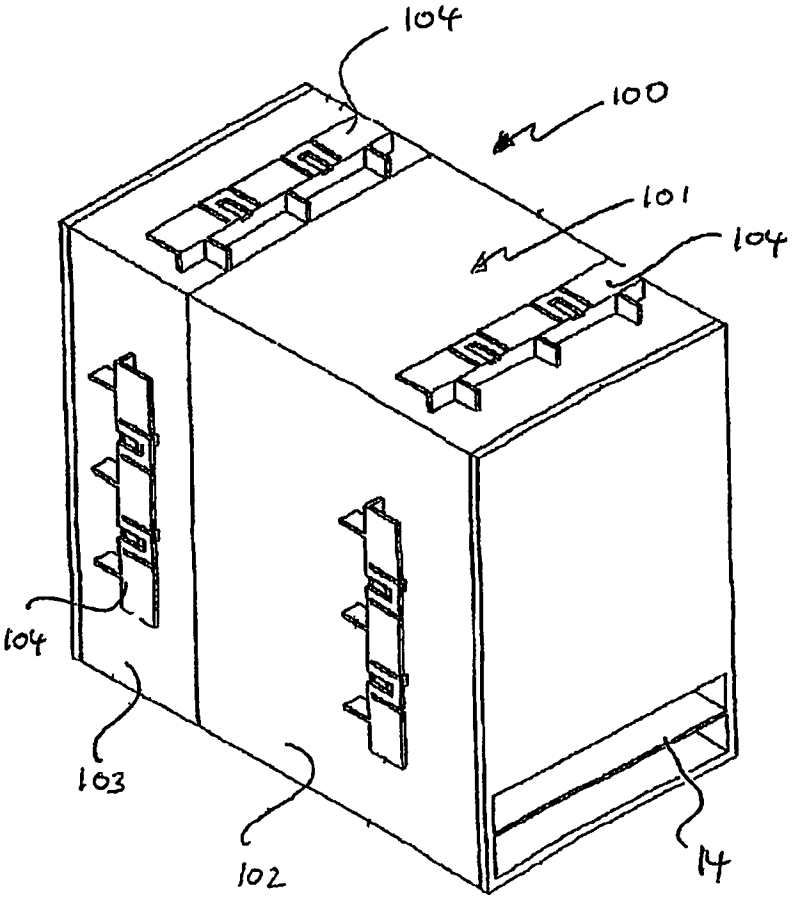
FIGS. 8*a* and 8*b* illustrate a ventilation device of FIG. 1 with a modified housing design.
Figure 8A:
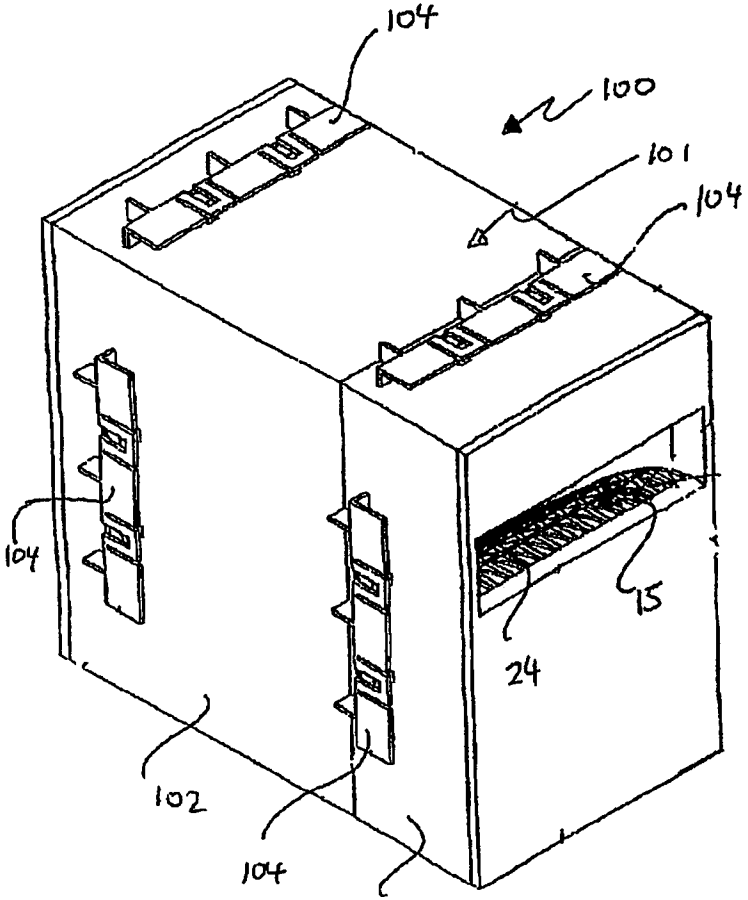
Figure 9:
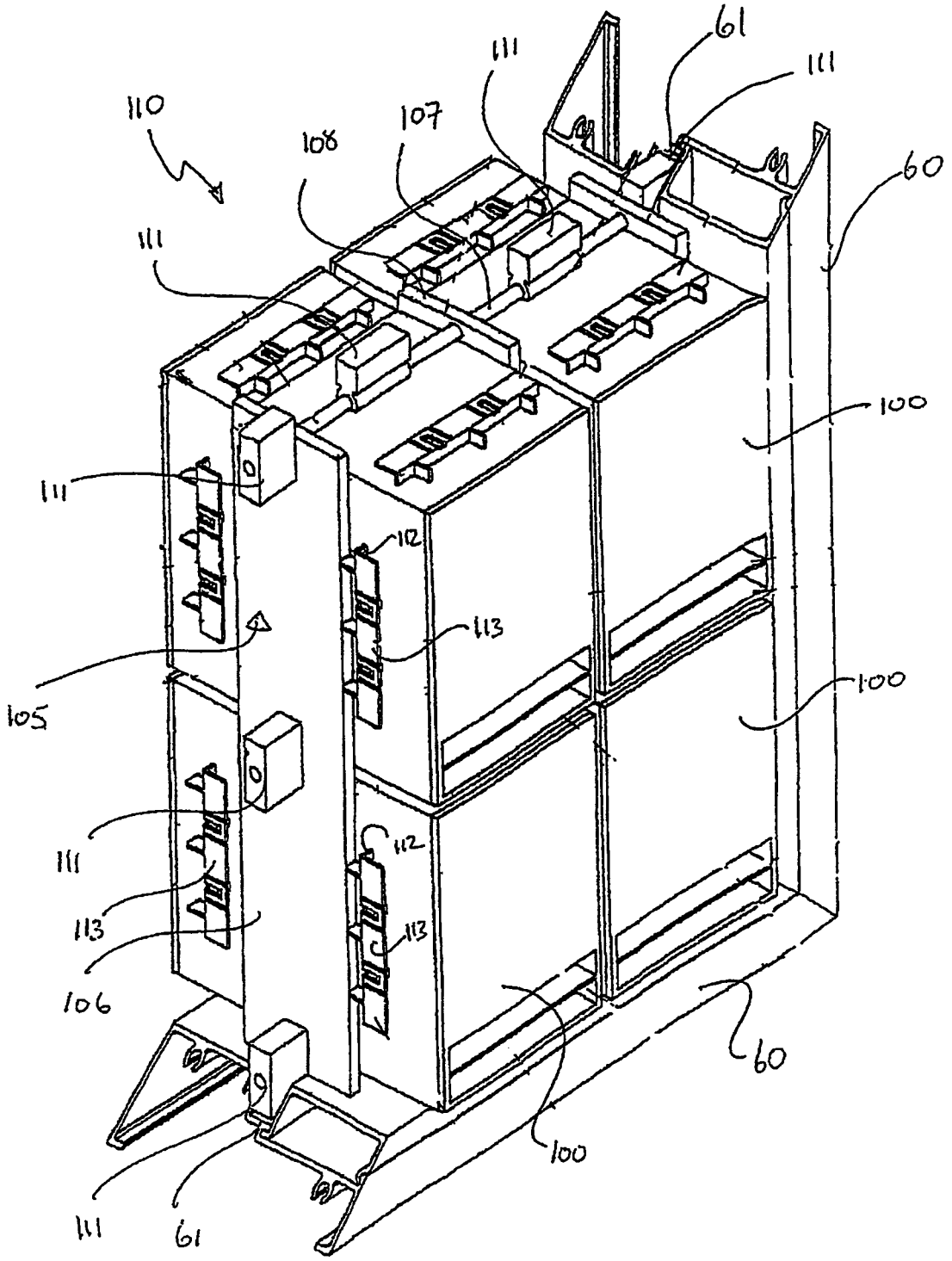
FIG. 9 illustrates a bank of the ventilation devices of FIG. 8*a* and 8*b* using an alternative frame system.

FIGS. 8*a*, 8*b* and 9 illustrate a further embodiment of the ventilation device 10. The main variation in the device as illustrated in FIGS. 8*a*, 8*b* and 9 over the earlier embodiments is directed to the technique by which those devices are interconnected as a bank and installed in a glazing frame. Accordingly, this embodiment shares many features of the earlier embodiment and like features have been given reference numerals.

As shown in FIGS. 8*a* and 8*b*, each ventilation device 100 comprises a body which, in this embodiment, comprises a housing 101 that has two parts 102 and 103 which are connectable by a snap-fit arrangement. The first part 102 also has a face plate (not shown) that can be removed to access the interior of the ventilation devices. The housing 101 encases the two arrays 22 and 23 of quarter wavelength attenuator tubes 24 as in the earlier embodiment. The device 100 includes coupling elements 104 in the form of brackets disposed on the outer surface of each part 102 and 103 of the housing 101. The brackets 104 allow interconnection of adjacent ventilation devices and also allows the location of a frame 105 as will be discussed in more detail below with reference to FIG. 9.

Referring now to FIG. 9, a bank 110 of the ventilation devices 100 as shown in FIGS. 8*a* and 8*b* is provided. The ventilation devices 100 are interconnected together by virtue of the brackets 104. In addition a frame 105 is disposed around the interconnected devices 100. Unlike the earlier embodiment where the frame 40 was made from an extruded frame element 42, in the embodiment shown in FIG. 9, the frame 105 comprises plates 106 which form the upright members of the frame 105 and rods 107 that interconnect those plates 105. In addition to extending solely around the periphery of the interconnected bank of ventilation devices 100, intermediate plates 108 extend between adjacent ventilation devices.

Both the plates 106 and the rods 107 include coupling elements 111 which are designed to be received within the channel 61 of a glazing frame 60 so as to enable the bank 110 to be secured to that glazing frame.

As discussed above, each of the housing parts 102 and 103 comprise four brackets 104. Each bracket 104 has an L-shaped cross-section having a first portion 112 attached to a housing side of each ventilation device, and a second portion 113 that forms a right angle with the first portion and is parallel with the respective side. The brackets 104 are arranged so that on interconnecting adjacent devices, the brackets 104 interconnect and also contact with the frame plates 106 so that the ventilation devices are located in a predetermined position and the plates 107 are captured by the brackets 104.

In general, the bank 110 of the ventilation devices 100 is assembled as follows. An array of first parts of the modules (typically in first housing parts 102) are arranged to form an array of parts. The first parts are interconnected by the brackets 104. The frame plates 107 and intermediate plates 108 are positioned between adjacent first parts 102 and the respective second parts 103 are interconnected with the first parts so that these frame members are captured by the modules, in this way the frame is within the bank 110 of devices.

Once assembled, the bank 110 can be fitted to the glazing frame in a similar manner to that described above with reference to the earlier embodiment.

The components used in the ventilation devices can be made from any suitable material but in a preferred form are made from a plastic typically by an injection moulding process. The frame elements are typically metal with the frame element 42 typically formed by an extruded process and made from aluminium.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and modifications may be made to the parts previously described without departing from the spirit or ambit of the invention.

The invention claimed is:

1. A ventilation device comprising a body having first and second ports, a ventilation passage extending through the body between the ports to allow airflow through the body, a noise attenuation device arranged to attenuate noise transmission through the passage from the first to the second port, the noise attenuation device comprising first and second arrays of attenuator tubes, the first array of attenuator tubes extending from a first wall of the body, and the second array of attenuator tubes extending from a second wall of the body, wherein the first and second arrays of attenuator tubes are disposed on respective opposite sides of the passage, the tubes each having a mouth that opens to the passage and a central axis extending from the center of the mouth in the direction of the elongation of that tube, wherein the tubes in the first array oppose the tubes in the second array with the central axes of the opposing tubes at the region of their mouths being mutually inclined at a substantially right angle and wherein the first and second walls are at substantially right angles.

2. A ventilation device according to claim 1, wherein at least some of the tubes in both the first and second arrays open to the passage so that the central axes at their mouths are angled towards the first port.

3. A ventilation device according to claim 1, wherein the tubes are substantially linear and the central axes of the respective tubes of an array are generally parallel.

4. A ventilation device according to claim 1, wherein the body includes a housing in which the first and second arrays are disposed, the housing being shaped generally as a rectangular prism having both opposite and front back surfaces, opposite top and bottom surfaces and opposite side surfaces, and wherein the ports are disposed in the front and back surfaces and the tubes of one array are disposed generally with their axes substantially perpendicular to the front and back surfaces, whereas the axes of the tubes of the second array are disposed substantially perpendicular to the top and bottom surfaces.

5. A ventilation device according to claim 1, wherein at least some of the attenuated tubes of at least one of the arrays incorporate an acoustic transmissive partition which separates at least a portion of those attenuator tubes from the ventilation passage.

6. A ventilation device according to claim 5, wherein the acoustic transmissive partition is made from a polymeric material having a thickness of less than 100 μm.

7. A ventilation device according to claim 5, wherein the acoustic transmissive partitions are in the form of a film.

8. A ventilation device according to claim 7, wherein the film is applied over the mouths of the attenuator tubes so as to form a lining of the ventilation passage.

9. A ventilation device according to claim 1 wherein the first and second arrays of attenuator tubes are spaced apart on respective opposite sides of the passage.

10. A ventilation device according to claim 1 wherein each array comprises tubes of different lengths.

11. A ventilation device according to claim 1 wherein the opposing surfaces of the first and second arrays define opposite sides of the passage, the surfaces being profiled so that the passage follows a kinked path between the first and second ports.

* * * * *

UNITED STATES PATENT AND TRADEMARK OFFICE

CERTIFICATE OF CORRECTION

PATENT NO. : 8,641,494 B2
APPLICATION NO. : 11/579628
DATED : February 4, 2014
INVENTOR(S) : Christopher James Matthews It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2127 days.

Signed and Sealed this
Twenty-second Day of September, 2015

Michelle K. Lee

Michelle K. Lee
*Director of the United States Patent and Trademark Office*